US005967806A

United States Patent [19]

Patterson

[11] Patent Number: 5,967,806

[45] Date of Patent: Oct. 19, 1999

[54] ELECTRICAL CONNECTOR ARRANGEMENT

[75] Inventor: Robert Allen Patterson, Harrisburg, Pa.

[73] Assignee: The Whitaker Corporation, Wilmington, Del.

[21] Appl. No.: 08/898,194

[22] Filed: Jul. 22, 1997

Related U.S. Application Data

[60] Provisional application No. 60/025,073, Aug. 30, 1996.

[51] Int. Cl.[6] ..... H01R 4/66

[52] U.S. Cl. ..... 439/108; 439/607

[58] Field of Search ..... 439/108, 607

[56] References Cited

U.S. PATENT DOCUMENTS

| | | | |
|---|---|---|---|
| 3,744,005 | 7/1973 | Stizler | 339/75 MP |
| 4,601,527 | 7/1986 | Lemke | 339/14 R |
| 4,655,518 | 4/1987 | Johnson et al. | 339/17 LC |
| 4,836,791 | 6/1989 | Grabbe et al. | 439/79 |
| 4,867,690 | 9/1989 | Thumma | 439/79 |
| 4,869,677 | 9/1989 | Johnson et al. | 439/80 |
| 4,959,024 | 9/1990 | Czeschka | 439/607 |
| 5,104,329 | 4/1992 | Brown et al. | 439/108 |
| 5,176,526 | 1/1993 | Hillbish et al. | 439/108 |
| 5,228,864 | 7/1993 | Fusselman et al. | 439/108 |
| 5,241,453 | 8/1993 | Bright et al. | 361/704 |
| 5,307,242 | 4/1994 | Seibold et al. | 361/816 |
| 5,429,521 | 7/1995 | Morlion et al. | 439/108 |
| 5,443,392 | 8/1995 | Longueville et al. | 439/108 |
| 5,478,260 | 12/1995 | Kaufman et al. | 439/108 |
| 5,511,992 | 4/1996 | Thalhammer | 439/609 |
| 5,522,731 | 6/1996 | Clark et al. | 439/108 |
| 5,639,263 | 6/1997 | Zell et al. | 439/108 |

*Primary Examiner*—Paula Bradley
*Assistant Examiner*—Katrina Davis
*Attorney, Agent, or Firm*—Katherine A. Nelson

[57] ABSTRACT

An arrangement (10) of electrical connectors (12,112) and a circuit board (50) upon which they are mounted includes a strip (30) of ground contacts (34) disposed between selected ones of the connectors (12,112) and adjacent side surfaces (20) thereof. Each strip (30) of ground contacts includes a plurality of connecting sections electrically connected to ground circuits in the circuit board (50). The ground contacts (34) are adapted for becoming engaged by a ground shield (76) exposed on an outer surface of a complementary mating connector (60) mated with the selected board connector and be biased thereagainst to establish an assured ground connection therewith at a plurality of locations therealong.

4 Claims, 3 Drawing Sheets

ELECTRICAL CONNECTOR ARRANGEMENT

This application claims the benefit of U.S. Provisional Application(s) No. 60/025,073, filed Aug. 30, 1996.

FIELD OF THE INVENTION

This invention is directed to electrical connectors and more particularly to an array of electrical connectors on a circuit board or back plane.

BACKGROUND OF THE INVENTION

Most of today's electronic equipment use arrays of connectors on a circuit board such as a motherboard or back plane to mate with a plurality of complementary connectors on corresponding daughter cards. It is desirable in forming the arrays of connectors to use a minimum amount of real estate on the board so that the electronic equipment may be as compact as possible.

In some instances the same mother board or back plane may be used in various apparatus that use a daughter card having different capabilities, such as, for example, upgrading existing equipment. The upgraded daughter card connectors may require additional grounding capabilities than is available in the mother board connector. It is desirable, therefore, to provide or to retrofit selected connectors on the motherboard with additional grounding capability. In some motherboard and daughter card arrangements, only certain connectors of the daughter card include ground shielding that needs to be electrically connected to ground circuits on the motherboard. It is desirable, therefore, to provide only selected motherboard connectors with the ground capability thus allowing the daughter cards having the ground shield connectors to be electrically connected to the ground circuits of the board.

SUMMARY OF THE INVENTION

The present invention is directed to an arrangement of electrical connectors and a circuit board upon which they are mounted. The circuit board includes ground circuits accessible between selected ones of the connectors on the board. A common strip of ground contacts is disposed between selected ones of the connectors and adjacent side surfaces thereof. The ground contacts includes solder tails that are electrically connected to the board ground circuits. The ground contacts are adapted for becoming engaged by a ground shield exposed on a outer surface of a complimentary mating connector that is mated with the selected board connectors. The ground contacts are biased thereagainst to establish an assured ground connection therewith at a plurality of locations along the side surface. Upon mating the complimentary connector with the selected board mounted connector the ground contacts establish electrical connection between the mating connector ground shield and the ground circuits of the board.

In accordance with the invention the strip of ground contacts can be handled as a unit and inserted into through-holes of the motherboard at the desired locations. The ground shield of the mating connector is thereby interconnected at a plurality of locations. The strip of ground contacts is more readily handled than are individual contacts placed at desired locations. The ground contact strip includes a first connecting portion adapted to be received in through-holes of circuit board and a second connecting portion including a body having a cantilevered spring section. In the preferred embodiment the body of the second connecting portion further includes a anti-overstress tab that will engage touch the sidewall of an adjacent connector to prevent the second connecting section from being bent too far when the daughter card connector is mated to the motherboard connector.

An embodiment will now be described with reference to the following drawings.

DETAILED DESCRIPTION OF THE DRAWINGS

For purposes of illustration the invention will be described in relation to connectors 12 and 112 that are substantially the same with the exception of the number of rows of electrical terminals therein. The same numbers, therefore, will be used for the corresponding parts.

Figure 1:
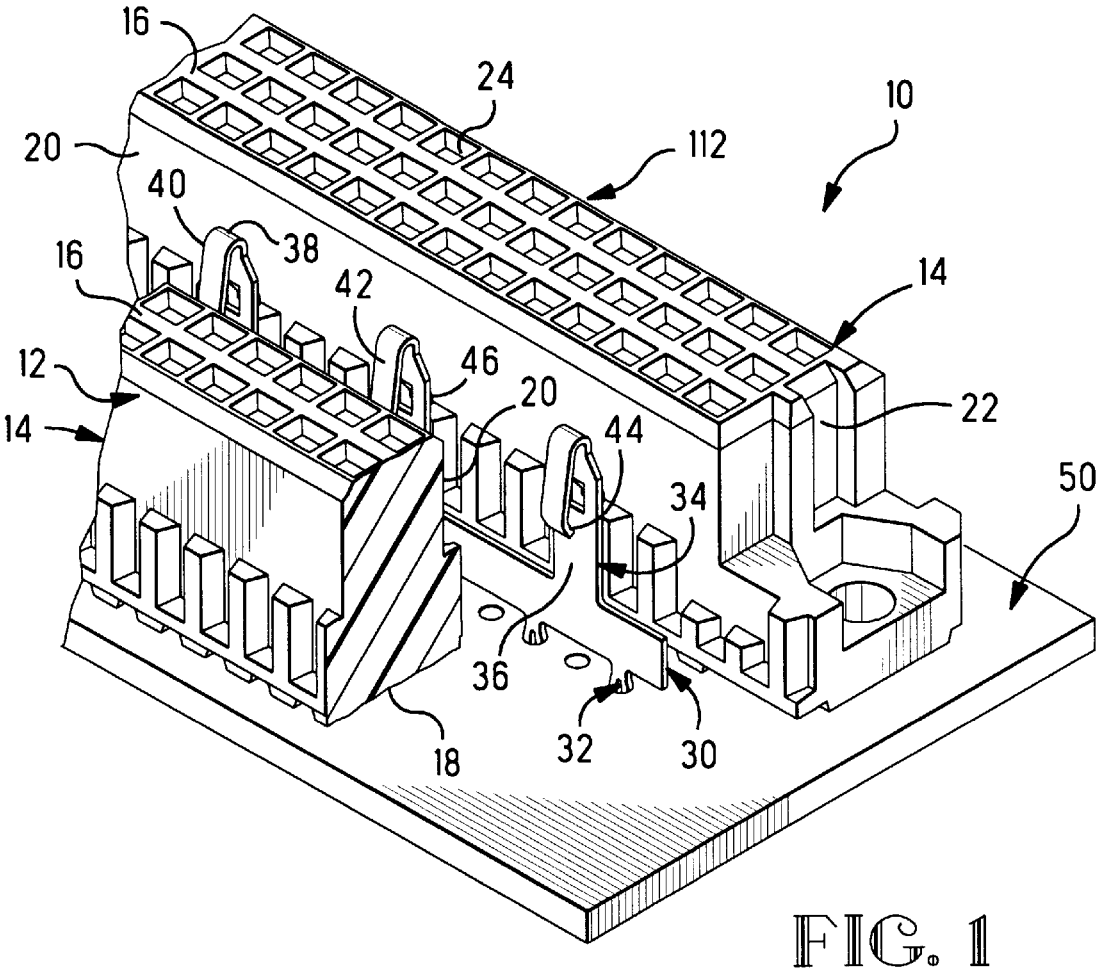
FIG. 1 is an isometric fragmentary view of two connectors on a circuit board having a ground strip made in accordance with the invention disposed therebetween.
Figure 2:
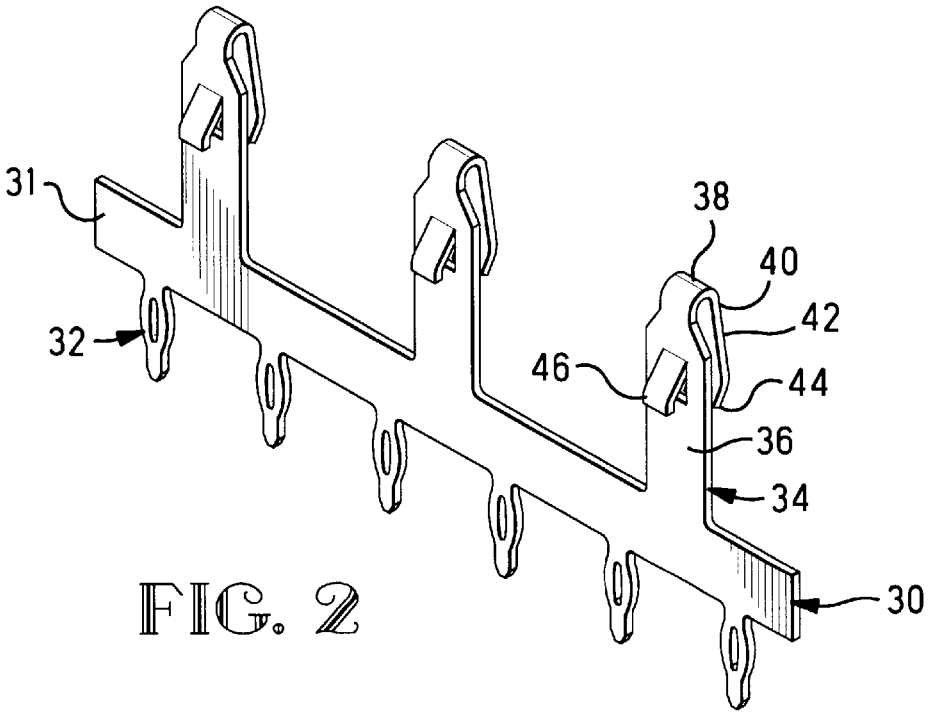
FIG. 2 is an isometric view of the strip of ground contacts.
Figure 3:
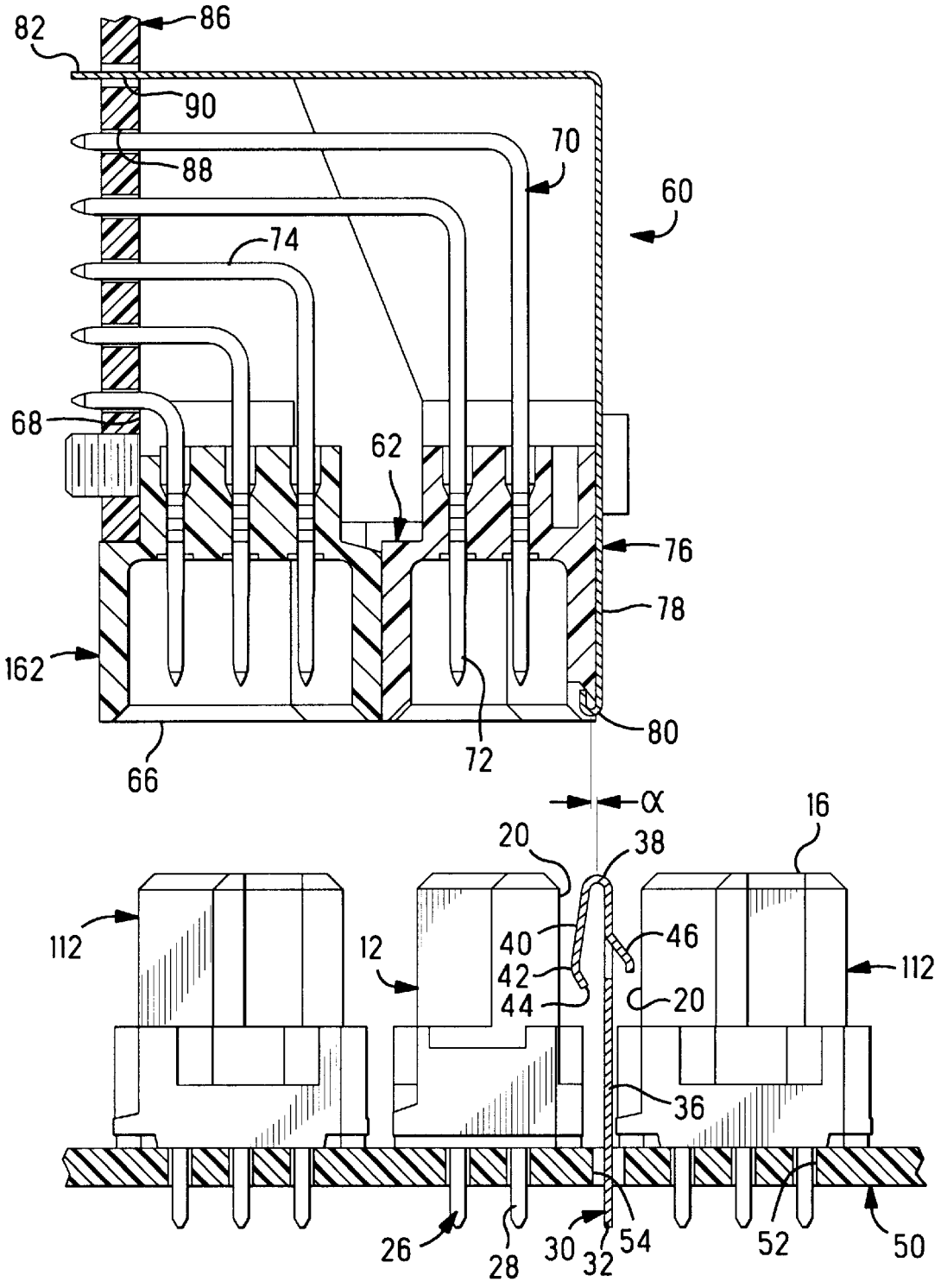
FIG. 3 is a cross-sectional view of a mating connector having a ground shield on the outer surface thereof and in position to mate with two connectors on the circuit board and a strip of ground contacts associated with one of the connectors for engaging the ground shield.
Figure 4:
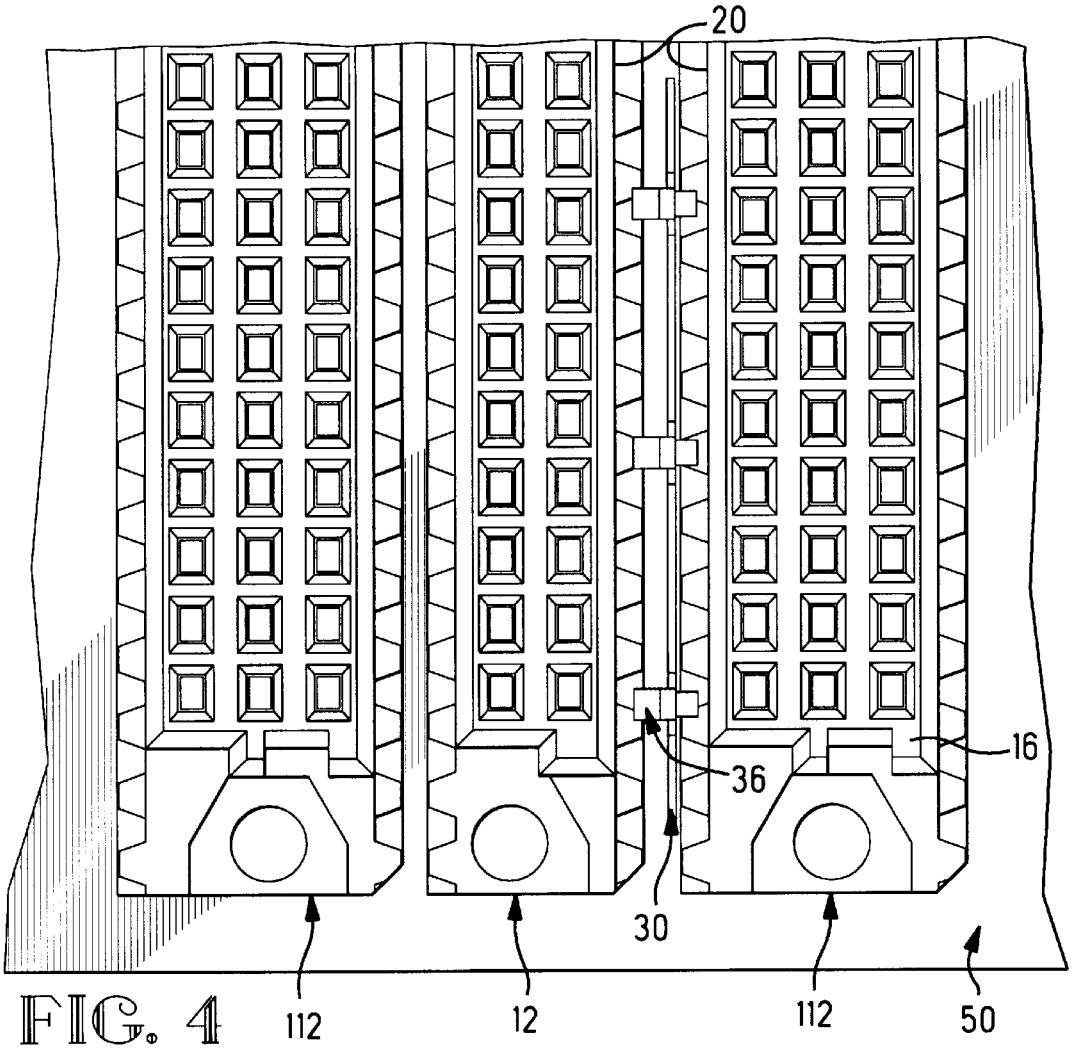
FIG. 4 is a top plan view of the motherboard connector arrangement shown in FIG. 3.

Referring now to FIGS. 1 through 5, arrangement 10 includes a plurality of electrical connectors 12, 112 and at least one grounding strip 30 mounted to a circuit board 50. Each connector 12, 112 includes a housing 14 having opposed mating and mounting faces 16, 18, sidewalls 20 and endwalls 22. Housing 14 includes a plurality of terminal receiving passageways 24 having electrical terminals 26 disposed therein. Electrical terminals 26 have solder tails 28 that are disposed in respective through-holes 52 of the circuit board 50 as best seen in FIG. 3. The strip 30 of ground contacts includes a strap portion 31 having a plurality of first connecting sections 32 extending outwardly from one edge thereof and a plurality of second connecting sections 34 defining ground contacts extending in an opposite direction from the opposed edge thereof. First connecting sections 32 are shown as compliant pin terminals that are adapted to be disposed in respective through-holes 54 of circuit board 50. Each second connecting sections or ground contact 34 includes a body 36 having a bend 38 at an upper end thereof and a spring arm 40 extending from the bend to a leading end 44 and defining an essentially U-shaped spring arm. Spring arm 40 over lies a portion of the body 36 and is spaced therefrom. Spring arm 40 includes a contact surface 42. The strip 30 provides a plurality of ground contacts 34 that are commoned by the strap 31. In the preferred embodiment ground contact strip 30 is stamped and formed from a copper alloy or the like as known in the art. In the preferred embodiment body 36 further includes an anti-overstress tab 46 extending outwardly from the body 36 in a direction opposite to the spring arm 40. The strip 30 of ground contacts 30 is adapted to be disposed along the respective sidewall 20 of a selected connector 12, 112 with the cantilevered spring arm 40 extending toward the sidewall 20 and spaced therefrom, as best seen in FIG. 3.

Figure 5:
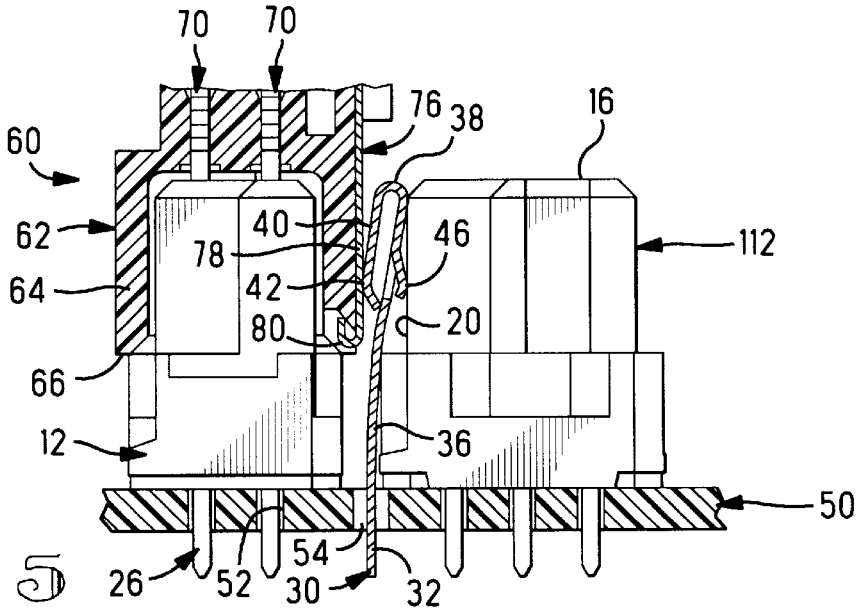
FIG. 5 is a view similar to that of FIG. 3 after the connectors have been mated.

FIGS. 3 and 5 show the mother board connectors 12, 112 as they are being mated with connector assembly 60 on a daughter card 86. For purposes of illustration mating assembly 60 is shown in cross-section, and includes two electrical connectors 62, 162 each having a housing 64 with a mating face 66 and a mounting face 68. The connectors 62, 162 have a plurality of terminals 70 disposed therein having first connecting section 72 adapted to mate with complimentary terminals (not shown) of the motherboard connectors 12, 112 and second connecting section 74 adapted to be received in corresponding through-holes 88 of circuit board 86. The mating assembly 60 further includes a ground shield 76 disposed along the outer surface thereof having a mating portion 78 at the leading end 80 and a board connecting portion 82 at the opposite end adapted to be received in a corresponding through hole 90 of circuit board 86. As the connector assembly 60 on daughter card 86 is brought into electrical engagement with the corresponding motherboard connectors 12, 112 the mating portion 78 at the leading end 80 of the shield 76 engages the contact surface for the spring arm 40 such that the contact surface 42 is an electrical engagement with the outer surface 78 of the ground shield 76 as shown in FIG. 5.

As can be seen from FIGS. 3 and 5 the anti-overstress tab 46 prevents the body 36 of the ground contact 34 from being bent too far away from the connector being mated thereto such that the contact 34 will not resile back toward the connector 12 when assembly 60 is unmated from the mother board connectors.

As can be seen from FIG. 5, when connector assembly 60 is mated to the mother board connectors and the ground contacts 34 are engaged with shield 76, access to the adjacent connector 112 is prevented. It is to be understood that the mother board connectors may be spaced apart a sufficient distance that daughter cards may be inserted at all locations. As can best be seen from FIGS. 3 and 5 the curved bend 38 of the ground contact as opposed to a sheared edge reduces the chances of stubbing when the connectors are mating. Additionally the tapered surface of the anti-overstress tab 46 prevents stubbing of a daughter card connector mating with the mother board connector 112 on the opposite side of the ground contact 34. The sloping surface of tab 46 will tend to guide the mating daughter card connector into position.

The present invention provides a strip of ground contacts that is able to be handled as an unit rather than as individual contacts selectively placed along side a connector housing to provide a desired grounding capability.

It is thought that the electrical connector arrangement of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. An arrangement of electrical connectors and a circuit board upon which they are mounted comprising:

an array of connectors mounted to a circuit board;

said circuit board including ground circuits accessible between adjacent sidewalls of selected ones of adjacent connectors on said board; and a common strip of ground contacts disposed between said adjacent sidewalls of said selected ones of said adjacent connectors on said board, said strip of ground contacts including a plurality of connecting sections adapted to be electrically connected to said ground circuits of said board;

said ground contacts of said strip being adapted for becoming engaged by a ground shield exposed on an outer surface of a complementary mating connector mated with one of said selected adjacent connectors on said board and being biased thereagainst to establish an assured ground connection therewith at a plurality of locations therealong;

whereby upon mating said complementary mating connector with said one selected connector on said board, said ground contacts establish a plurality of electrical connections between said ground shield of said complementary mating connector and said ground circuits of said board.

2. The arrangement of claim 2 wherein said connecting sections of said strip of ground contacts are compliant sections adapted to be received in through-holes of said board for engaging said ground circuits therein.

3. The arrangement of claim 2 wherein said ground contacts of said strip include a body and an essentially U-shaped spring arm extending to a free end and having a contact surface proximate said free end.

4. The arrangement of claim 4 wherein said body includes an anti-overstress tab extending outwardly therefrom in a direction opposite to said spring arm and adapted to engage a sidewall of the other of said selected adjacent connectors.

* * * * *